United States Patent [19]

Dullabaun et al.

[11] Patent Number: 4,721,219

[45] Date of Patent: Jan. 26, 1988

[54] COMPOSITE, VACUUM INDICATING CLOSURE

[75] Inventors: Paul W. Dullabaun; William E. Fillmore, both of Toledo, Ohio

[73] Assignee: Owens-Illinois Closure Inc., Toledo, Ohio

[21] Appl. No.: 931,271

[22] Filed: Nov. 17, 1986

[51] Int. Cl.[4] ..... B65D 45/10

[52] U.S. Cl. ..... 215/274; 215/230; 215/318

[58] Field of Search ..... 215/274, 276, 350, 318, 215/230

[56] References Cited

U.S. PATENT DOCUMENTS

| | | | |
|---|---|---|---|
| 1,882,995 | 10/1932 | Scofield | 215/350 |
| 3,371,813 | 3/1968 | Owen et al. | 215/334 |
| 4,473,163 | 9/1984 | Geiger | 215/250 |

*Primary Examiner*—Stephen Marcus
*Assistant Examiner*—Nova Stucker
*Attorney, Agent, or Firm*—H. G. Bruss

[57] ABSTRACT

A vacuum indicating closure for a container for the packaging of a vacuum-packed product, the closure being of two-piece construction and having a metal lid portion which is retained in sealing engagement with the rim of a container by a plastic ring portion. The metal lid portion has a vacuum indicating button centered therein, which vacuum indicating button can flex downwardly from its normal position into the headspace of a container under the influence a sub-atmospheric or negative pressure in the headspace. The ring portion of the closure has a radially inwardly projecting annular flange at the top thereof to urge a peripheral portion of the lid portion of the closure against the rim of the container, the ring portion of the container further having a radially inwardly projecting annular bead to lock the lid portion of the closure against the underside of the annular flange of the ring portion so that the lid portion and the ring portion can be conveniently handled in unison. The ring of the closure further has an annular skirt with radially inwardly projecting ribs thereon, whereby the closure can be mechanically attached to a helical threaded container finish by a push-on action, the ribs being deformable under compressive loadings by the helical thread on the container finish to deform and thereby ensure that the closure under normal circumstances can be removed from the container by an unscrewing motion.

14 Claims, 5 Drawing Figures

COMPOSITE, VACUUM INDICATING CLOSURE

BACKGROUND OF THE INVENTION

1. Field of the Invention

This invention relates to a composite closure for a container for the packaging of a product under at least partial vacuum, which closure includes a metal lid that has a portion whose position is altered by a loss of vacuum within the container to give a visual indication of such loss of vacuum, and a plastic ring to secure the metal lid to the rim of a container. The closure is of the push-on, twist-off type.

2. Description of the Prior Art

Many food products which are packaged in glass jars are packaged under a partial vacuum to prevent spoilage or to preserve flavor, and it is important that the closure for such a container be able to seal the container properly to maintain the vacuum in the container until the first opening thereof. It has also been recognized that it is desirable for a closure for a container for a vacuum-packed product to incorporate means which will indicate the presence or absence of the desired degree of vacuum, and the prior art is familiar with metal closures which incorporate such a feature. For example, U.S. Pat. No. 3,152,711 (G. V. Mumford et al.), which is assigned to the assignee of this application, discloses a one-piece metallic closure in which the top panel of the closure incorporates a domed central portion, which domed central portion is deflected downwardly by the presence of a suitable degree of partial vacuum in the associated container. Because of the inherent elasticity of the metal of the closure, the deflected domed central portion will return to its normal position upon the release of the vacuum and the resulting repressurization of the container, thereby providing an indication of such release of container vacuum which is detectable visually, or by various types of electromechanical or electro-optical types of inspection equipment. U.S. Pat. Nos. 3,062,396 (G. J. Foss et al.), 3,160,302 (G. F. Chaplin), and 4,533,059 (W. J. Kapolas et al.) also disclose one-piece metallic vacuum indicating closures that operate in a similar manner, and U.S. Pat. No. 3,836,033 (A. Pdesta) discloses a two-piece vacuum indicating closure having a metallic closure panel and a separate metallic closure panel retention skirt that otherwise also operates in a similar manner.

As is noted in U.S. Pat. No. 4,093,094 (N. J. Smalley et al.), which is also assigned to the assignee of this application, a reference which discloses a two-piece vacuum indicating closure that is useful in a home canning system, certain advantages are obtained in a vacuum indicating closure when at least the skirt portion thereof is formed from a thermoplastic material. However, the closure system of the aforesaid U.S. Pat. No. 4,093,094 requires separate handling of the metal lid and plastic ring components thereof, since the closure system of such reference does not incorporate means to positively interlock the metal lid and the plastic ring, and, thus, the use of the closure system of the aforesaid of U.S. Pat. No. 4,093,094 is not suitable for use in a packaging plate where it is necessary to mechanically apply closures to containers at a high rate of speed in order to be able meet the cost constraints that apply to any such industrial operation. Further, the plastic skirt of the aforesaid U.S. Pat. No. 4,093,094 is affixed to the finish portion of the associated container by mutually engageable helical threads, an attachment technique which has certain drawbacks for use in an industrial operation relative to closures which can be applied by a push-on action, as is described in co-pending application Ser. No. 395,397, filed on July 6, 1982, by George V. Mumford, an application which is also assigned to the assignee of this application, and in U.S. Pat. No. 3,371,813 (R. C. Owen et al.) and in British Patent Specification No. 635,262 (E. T. Webb), references which also describe various types of push-on, twist-off closures.

SUMMARY OF THE INVENTION

According to the present invention there is provided a two-piece or composite closure for a container for a vacuum-packed product, which closure is suitable for mechanical application on a high speed basis in a food or beverage packaging plant. The closure incorporates a metal lid and a plastic ring which mechanically engages and retains the metal lid and which incorporates deformable plastic ribs on its inside surface by which it can secure itself and the associated metal lid to the helical thread of a container finish by a push-on action. The metal lid of the closure has a centrally located, deformable, vacuum indicating button whch will be drawn from its normal position into the head space of the associated container by the presence of a vacuum therein, and which will return to its original, normal position upon the loss of vacuum in the container head space.

It is contemplated that a closure according to the present invention will have particular utility as a closure for a widemouth food and beverage container, particularly for infant formula or juice containers with a nominal finish diameter of 40 millimeters, a size which permits the product of the container to be dispensed through a standard nurser fitment, after removal of the original closure from the container.

Accordingly, it is an object of the present invention to provide a composite closure for a container for the packaging of a vacuum-packed product in which at least the skirt portion of the closure is formed from a thermoplastic material and which can be rapidly and inexepensively applied to the finish of a container which has a helical thread by a simple push-on motion.

It is a further object of the present invention to provide a two-piece closure for a container for the packaging of a vacuum-packed product in which such closure includes separate top panel and skirt elements which are mechanically interengageable with one another, to facilitate the rapid and reliable mechanical handling of such closure elements in a food or beverage packaging plant.

It is also an object of the present invention to provide an improved package for the packaging of a beverage for infants, which beverage is packaged under vacuum, or partial vacuum, and which package includes a novel and improved two-piece closure with a movable vacuum indicating central panel portion to provide a positive and reliable indication of the loss of vacuum in such package.

For a further understanding of the present invention and the objects thereof, attention is directed to the drawing and the brief description thereof, to the detailed description of the preferred embodiment and to the appended claims.

DETAILED DESCRIPTION OF THE PREFERRED EMBODIMENT

Figure 5:
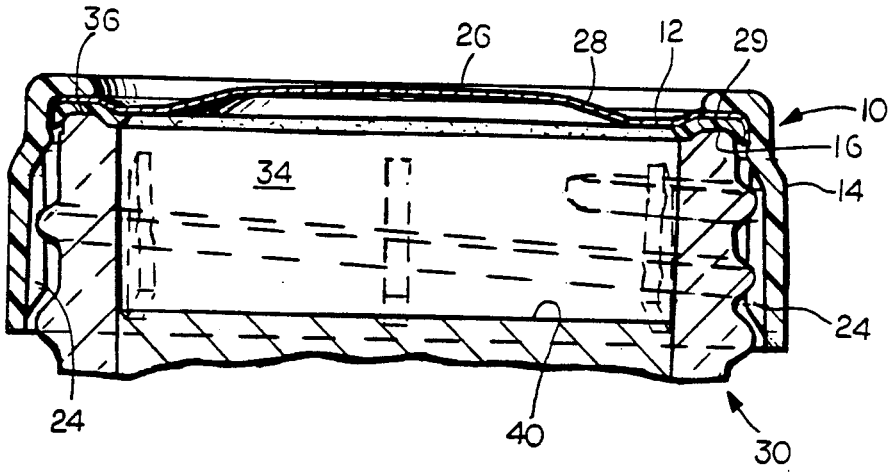
FIG. 5 is a view similar to FIG. 4 showing the closure of FIGS. 1 through 3 after the loss of vacuum in the container to which it is applied.
Figure 4:
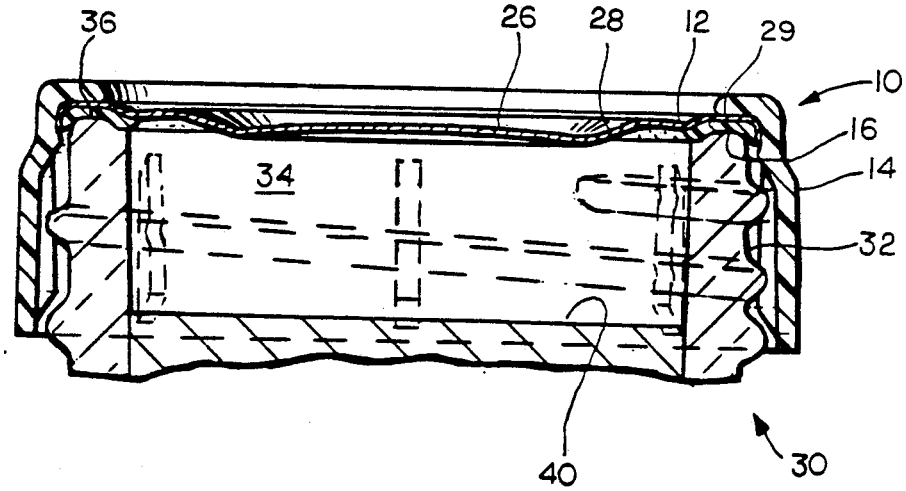
FIG. 4 is a fragmentary sectional view of the closure of FIGS. 1 through 3 as applied to the finish of a container which has a vacuum or a partial vacuum therein.

A closure according to the present invention is indicated generally by reference numeral 10 in the drawing. The closure 10, as is shown in FIGS. 4 and 5, is adapted to be applied in closing relationship to a container, indicated generally be reference numeral 30, which is of a type that is suitable for the packaging of a food product or other product of a type which is advantageously packaged under sub-atmospheric pressure or partial vacuum conditions to prevent spoilage or preserve flavor. The packaged product is identified by reference numeral 40 in FIGS. 4 and 5. Typically, the container 30 may constitute a conventional widemouth glass container, for example, the type of container which is used in the packaging of infant formula and infant juice products, a container which is usually provided with a finish diameter (the "T" dimension, or the nominal outside diameter of the container thread) of 40 millimeters, to accommodate a standard nurser fitment to be used in dispensing the product 40 from the container 30 after the removal of the closure 10 from the container 30.

As is shown in FIGS. 4 and 5, the container 30 is provided with a threaded neck or finish portion 32 which surrounds an open mouth 34 of the container 30, the mouth 34 terminating in a rim 36.

The closure 10 of the present invention is made up of a metallic lid portion 13 and a plastic ring portion 14 which secures the lid portion 12 to the rim 36 of the container 30, the underside of the lid portion 12 having a sealing or gasket material 16 applied thereto to facilitate the formation of a seal between the closure 10 and the container 30, to help maintain the desired degree of vacuum in the container 30. The sealing material may, for example, be made up of a conventional ring of a plastisol sealing compound, as is known in the art.

The ring portion 14 of the closure 10 is made up of an annular skirt 18 and an inwardly projecting annular flange 20 at the uppermost portion of the annular skirt 18, the annular flange 20 and the annular skirt 18, preferably, being molded in a single piece from a suitable semi-rigid thermoplastic material, for example from a high density polyetheylene or polypropylene, by injection molding or compression molding. In cases where the ring portion 14 is expected to encounter high processing temperatures during the processing of the filled and capped container 30, it is preferably formed from polypropylene filled with calcium carbonate or similar material. The annular flange 20 of the ring portion 14 has an inside diameter which is less than the outside diameter of the lid portion 12, and thus the annular flange 20 serves to positively urge the periphery of the lid portion 12 against the rim 36 of the container 30. Further, the ring portion 14 of the closure 10 is provided with inwardly projecting annular bead means, preferably in the form of a series of spaced apart arcuate beads 22 to avoid the possibility of imposing excessive loads on the lid portion 12 during assembly, which are positioned below the underside of the annular flange 20 and which have an inside diameter that is slightly less than the outside diameter of the lid portion 12, thereby serving to positively retain the lid portion 12 against the underside of the annular flange 20 of the ring portion 14, in a snap-fit between the lid portion 12 and the ring portion 14, to facilitate the mechanical handling of the closure 10 by high speed closure applicating equipment.

The inside of the annular skirt 18 of the ring portion 14 of the closure 10 is provided with a plurality of spaced-apart, generally vertically extending ribs 24 formed intregally therewith and projecting radially inwardly therefrom. The inside surface of each of the ribs 24 projects radially inwardly past the tip of the helical thread of the finish portion 32 of the container 30, as is clear from FIGS. 4 and 5 of the drawing, and each of the ribs 24 is deformable under the compressive loads that result from the attachment of the closure 10 to the container 30, which attachment may be accomplished by a simple push-on motion of the closure 10 with respect to the finish portion 32 of the container 30. Thus, upon the deformation of the portions of the ribs 24 that are compressably loaded by virtue of the engagement of such portions with the helical thread of the finish portion 32 of the container 30, the closure 10 can generally be removed from the container 30 by an unscrewing motion. Preferably, each rib 24 has a deeper portion **24*a* near the bottom thereof which projects radially inwardly to a greater extent than any other portion of such rib 24. The deeper portion 24*a* of each the ribs 24 serves to offset to some degree the stretching of the annular skirt 18 of the ring portion 14 of the closure 10 that can occur near the bottom of such annular skirt where the annular skirt 18 has less radial restraint than it does near the top where it derives such radial restraint from the attachment of the annular flange 20 thereto, to thereby provide for enhanced engagement or "purchase" between each of the closure ribs 24 and the helical thread on the finish portion 32 of the container 30. Each rib 24 also has a tapered portion 24*b* below the deeper portion 24*a* which tapers outwardly and downwardly from the deeper portion, preferably to the inside surface of the annular skirt 18, to facilitate the application of the closure 10 to the container 30 by helping to center the closure 10 on the finish portion 32** during a mechanical capping operation.

Figure 1:
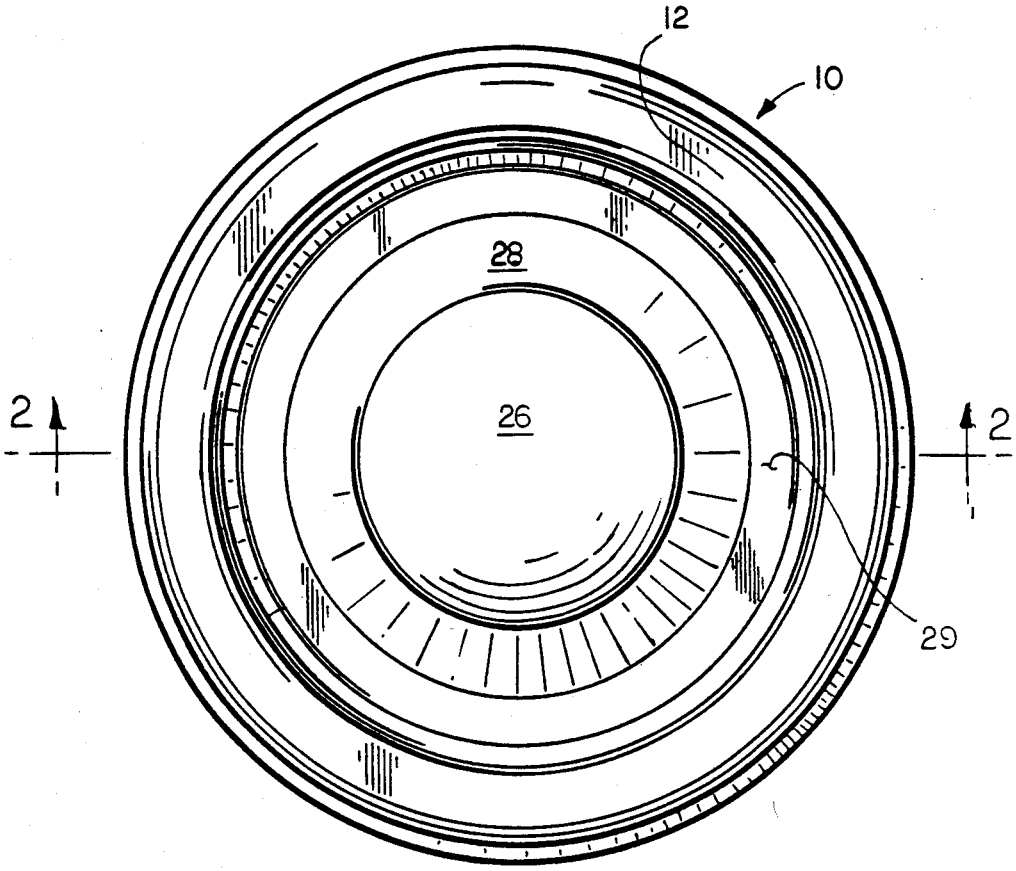
FIG. 1 is a top plan view of the preferred embodiment of a closure according to the present invention.
Figure 2:
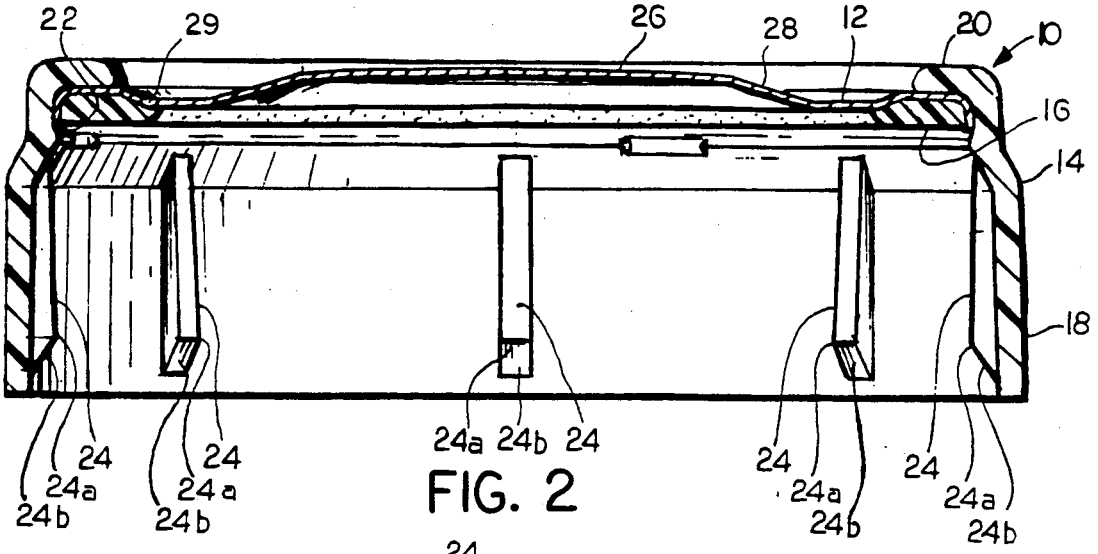
FIG. 2 is a sectional view taken on line 2—2 of FIG. 1.
Figure 3:
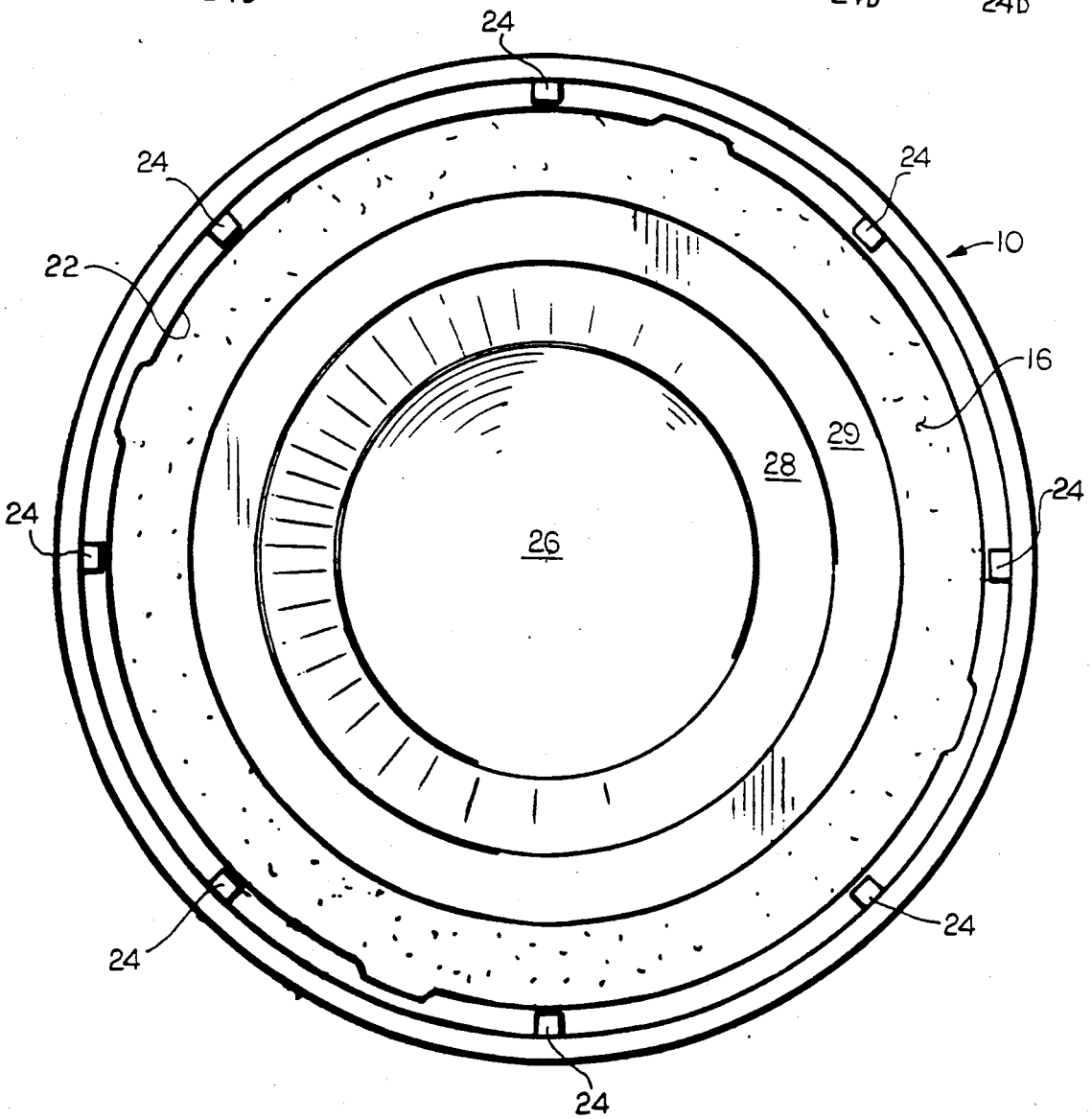
FIG. 3 is a bottom plan view of the closure of FIGS. 1 and 2.

The lid portion 12 of the closure 10 incorporates a vacuum indicating button 26 in its center, and a tapered portion 28 which surrounds and extends outwardly from the vacuum indicating button 26, the annular portion 28, in the normal orientation of the closure as shown in FIG. 2, extending generally downwardly from the vacuum indicating button 26. The annular portion 28, in turn, is surrounded by a second annular portion 29 which surrounds and extends outwardly form the annular portion 28, the sealing material 16 being affixed to the underside of the lid portion 12 of the closure 10 in the region of the second annular portion 29. Thus, when the closure 10 is in its closing position on the container 30 containing the vacuum packed product 40, as is shown in FIG. 4, the sub-atmospheric or negative pressure in the unfilled portion 30 above the top surface of the product 40, which is commonly referred to as the container "headspace", will draw the vacuum indicating button 26 downwardly so that the plane of its top surface will be below that of the second annular portion 29. If the vacuum in the headspace of the container 30 should be broken, for example, by an opening or a partial opening of the closure 10 or by a seal failure due to an irregularity in the top of the container finish or an improperly formed closure sealing material, the headspace will draw in air from its surroundings and will become repressurized. This increase in pressure on the underside of the vacuum indicating button 26, together with the residual stress in the lid portion 12 of the closure 10 by virture of the fact that it is formed from metal, a highly elastic material, will cause the vacuum indicating button 26 of the lid portion 12 of the closure 10 to move or pop upwardly into the position shown in FIG. 5, where the plane of the top surface of the vacuum indicating button 26 will be at a noticeably higher elevation, for example, above the elevation of the top surface of the second annular portion 29, as shown.

Through proper warnings or instructions on the closure 10 or the container 30 or in associated printed materials, a consumer or a retail store employee can be advised of any dangers which are associated with the use of the package which does not contain the desired vacuum at the time of the first opening, and can be instructed how to readily determine the presence or absence of such vacuum by the position of the vacuum indicating button 26. Additionally, this feature can be utilized as basis for continuous inspection of many filled containers in a packing plant where various types of electro-optical and electro-mechanical gaging equipment can be utilized to automatically read the position of the vacuum indicating button 26 and to discard any filled container 30 whose closure 10 does not have such vacuum indicating button 26 in an acceptable position.

Although the best mode contemplated by the inventors for carrying out the present invention as of the filing date hereof has been shown and described herein, it will apparent to those skilled in the art that suitable modifications, variations and equivalents may be made without departing from the scope of the invention, such scope being limited solely by the terms of the following claims.

What is claimed is:

1. A vacuum indicating closure for sealingly engaging the rim of a helically threaded finish on a container containing a vacuum-packed product, said closure comprising:

a metal lid portion having an outside diameter, said metal lid being adapted to span and sealingly engage the finish of the container, said metal lid portion further including a generally centrally located vacuum indicating button, an annular portion surrounding and extending radially outwardly from said vacuum indicating button, and a second annular portion surrounding and extending radially outwardly from said annular portion, said vacuum indicating button being movable relative to said second annular portion, under the influence of subatmospheric pressure conditions within the container, between a first position which indicates that such subatmospheric pressure conditions do not exist and a second position which indicates that such subatmospheric pressure conditions do exist; and a ring portion, said ring portion being molded from a thermoplastic material and having an annular skirt which is adapted to surround the helically threaded finish on the container, said annular skirt having a bottom, said ring portion further having an annular flange with an inside diameter, said annular flange extending generally radially inwardly from an end of said annular skirt and being adapted to engage at last a peripheral portion of said metal lid portion and to urge said at least a peripheral portion of said lid portion against the rim of the container, said annular skirt portion of said ring portion being provided with radially inwardly projecting bead means, said radially inwardly projecting bead means being spaced from said annular flange, said metal lid portion being mechanically engaged between said annular flange and said radially inwardly projecting bead means in a snap fit to permit said metal lid portion and said ring portion to be handled in unison, said annular skirt further having a circumferential series of spaced-apart, generally vertically extending ribs formed integrally with said annular skirt for engaging the helically threaded finish of the container to thereby permit said closure to be affixed to the helically threaded finish of the container, each of said ribs being subejct to deformation upon engagement with the helically threaded finish portion of the container, whereby said closure may be applied to the helically threaded finish of the container by a push-on motion and may be removed from the helically threaded finish by a twist-off motion, each of said ribs having a deeper portion that is disposed away from said annular flange of said ring portion, said deeper portion of each of said ribs projecting radially inwardly to a greater extend than any other portion of said each of said ribs and serving to offset any stretching that may occur near the bottom of said annular skirt of said ring portion away from said annular flange.

2. A closure according to claim 1 wherein said annular skirt, said annular flange, said radially inwardly projecting bead means and said radially inwardly projecting thread engaging means of said ring portion are integrally molded in a single piece from a thermoplastic material selected from the group consisting of high density polyethylene, polypropylene and modifications of polypropylene.

3. A closure according to claim 2 wherein said ring portion is molded by injection molding or compression molding.

4. A closure according to claim 1 wherein each of said ribs further has a taper portion that tapers downwardly from said deeper portion and away from said annular flange and inwardly toward said annular skirt, said taper portion helping to center said closure on the helically threaded finish portion of the container upon the application of said closure to the helically threaded finish portion of the container.

5. A closure according to claim 1 wherein said metal lid portion comprises a sealing material, said sealing material serving to help seal said closure to the rim of the helically threaded finish portion of the container.

6. A closure according to claim 1 wherein said radially inwardly projecting bead means is a circumferential series of spaced apart arcuate beads which series has an inside diameter that is at least slightly less than said outside diameter of said metal lid portion.

7. A closure according to claim 6 wherein the portion of said metal lid portion that is mechanically engaged between said annular flange and said annular bead has a thickness and wherein said annular bead and said annular flange define a space that has a thickness which is only slightly greater than said thickness of said portion of said metal lid portion, to securely engage said metal lid portion in said space between said annular bead and said annular flange.

8. In combination with a container containing a vacuum-packed product therein, and having a finish portion for receiving a closure to close and seal said container, said finish portion having a rim and an outwardly projecting and helically extending thread for engagement with a closure, a closure in engagement with said thread and sealingly engaging said finish portion, said closure comprising:

a metal lid portion having an outside diameter, said metal lid portion spanning and sealingly engaging said finish of said container, said metal lid portion including a generally centrally located vacuum indicating button, an annular portion surrounding and extending radially outwardly from said vacuum indicating button, and a second annular portion surrounding and extending radially outwardly from said annular portion, said vacuum indicating button being movable relative to said second annular portion, under the influence of subatmospheric pressure conditions in said container, between a first position which indicates that such subatmospheric pressure conditions do not exist and a second position which indicates that such subatmospheric pressure condition do exist; and a ring portion, said ring portion being molded from a thermoplastic material and having an annular skirt which surrounds said finish portion of said container including said thread, said annular skirt having a bottom, said ring portion further having an annular flange with an inside diameter, said annular flange extending generally radially inwardly from an end of said annular skirt and being adapted to engage at least a peripheral portion of said metal lid portion and to urge said at least a peripheral portion of said lid portion against said rim of said container, said annular skirt portion of said ring portion being provided with radially inwardly projecting bead means, said radially inwardly projecting bead means being spaced from said annular flange, said metal lid portion being mechanically engaged between said annular flange and said radially inwardly projecting bead means in a snap fit, said annular skirt further having a circumferential series of spaced-apart, generally vertically extending rims formed integrally with said annular skirt engaging said thread of said finish portion to maintain said closure in sealing engagement with said finish portion of said container, each of said ribs being subject to deformation upon engagement with said finish portion of said container, whereby said closure may be applied to said finish portion of said container by a push-on motion and may be removed from the same finish portion by a twist-off motion, each of said ribs having a deeper portion that is disposed away from said annular flange of said ring portion, said deeper portion of each of said ribs projecting radially inwardly to a greater extent than any other portion of said each of said ribs and serving to offset any stretching that may occur near the bottom of said annular skirt away from said annular flange.

9. A combiantion according to claim 8 wherein said annular skirt, said annular flange, said radially inwardly projecting bead means and said radially inwardly projecting thread engaging means of said ring portion of said closure are integrally molded in a single piece from a thermoplastic material selected from the group consisting of high density polyethylene, polypropylene and modifications of polypropylene.

10. A combination according to claim 9 wherein said ring portion of said closure is molded by injection molding or compression molding.

11. A combination according to claim 8 wherein each of said ribs further has a taper portion that tapers downwardly from said deeper portion and away from said annular flange and inwardly toward said annular skirt, said taper portion helping to center said closure on said finish portion of said container upon the application of said closure to said finish portion of said container.

12. A closure according to claim 8 wherein said metal lid portion of said closure comprises a sealing material, said rim of said sealing material serving to help seal said closure to said finish portion of the container.

13. A combination according to claim 8 wherein said radially inwardly projecting bead means of said closure is a circumferential series of spaced apart arcuate beads which series has an inside diameter that is at least slightly less than said outside diameter of said metal lid portion.

14. A combination according to claim 13 wherein the portion of said metal lid portion that is mechanically engaged between said annular flange and said annular bead has a thickness and wherein said annular bead and said annular flange define a space that has a thickness which is only slightly greater than said thickness of said portion of said metal lid portion, to securely engage said metal lid portion in said space between said annular bead and said annular flange.

* * * * *